US009820538B2

(12) United States Patent
Lebreton

(10) Patent No.: US 9,820,538 B2
(45) Date of Patent: Nov. 21, 2017

(54) TIMEPIECE PART, AND METHOD FOR PRODUCING SUCH A TIMEPIECE PART

(71) Applicant: Les Ateliers Horlogers Dior SA, La Chaux-de-Fonds (CH)

(72) Inventor: Etienne Lebreton, Renens (CH)

(73) Assignee: Les Ateliers Horlogers Dior SA (CH)

( * ) Notice: Subject to any disclaimer, the term of this patent is extended or adjusted under 35 U.S.C. 154(b) by 0 days.

(21) Appl. No.: 14/761,883

(22) PCT Filed: Feb. 7, 2014

(86) PCT No.: PCT/EP2014/052497
§ 371 (c)(1),
(2) Date: Jul. 17, 2015

(87) PCT Pub. No.: WO2014/122296
PCT Pub. Date: Aug. 14, 2014

(65) Prior Publication Data

US 2015/0359303 A1 Dec. 17, 2015

(30) Foreign Application Priority Data

Feb. 8, 2013 (CH) ..... 0419/13

(51) Int. Cl.
*G04B 47/04* (2006.01)
*A44C 17/02* (2006.01)
(Continued)

(52) U.S. Cl.
CPC ..... *A44C 17/02* (2013.01); *A44C 17/04* (2013.01); *A44C 27/001* (2013.01);
(Continued)

(58) Field of Classification Search
CPC ..... A44C 17/02; A44C 17/04; A44C 27/00; A44C 27/001; A44C 2/0067; G04B 5/16; G04B 19/12; G04B 47/042
(Continued)

(56) References Cited

U.S. PATENT DOCUMENTS 795,109 A * 7/1905 Dover ..... A44C 17/02 29/10
2,753,618 A * 7/1956 Stanziale ..... A44C 17/043 29/10
(Continued)

FOREIGN PATENT DOCUMENTS

CN 101449862 A 6/2009
CN 101983021 A 3/2011
(Continued)

OTHER PUBLICATIONS

International Search Report dated Jul. 7, 2014.
(Continued)

*Primary Examiner* — Amy Cohen Johnson
*Assistant Examiner* — Jason Collins
(74) *Attorney, Agent, or Firm* — Blank Rome LLP

(57) ABSTRACT

A timepiece (1) having at least one colored transparent stone (10), and a support (20) with at least one opening (200) for receiving this colored transparent stone (10). The ratio between the height (h) and width (L) of the colored transparent stone (10) is less than 50% , and the support (20) is made from anodised titanium or anodised aluminium. Advantageously, the color of the colored transparent stone (10) in the timepiece (1) is enhanced by that of the support (20).

12 Claims, 3 Drawing Sheets

(51) Int. Cl.

| | |
|---|---|
| ***A44C 17/04*** | (2006.01) |
| ***A44C 27/00*** | (2006.01) |
| ***G04B 19/12*** | (2006.01) |
| ***G04B 5/16*** | (2006.01) |
| *A44C 17/00* | (2006.01) |

(52) U.S. Cl.
CPC ..... *A44C 27/006* (2013.01); *G04B 5/16* (2013.01); *G04B 19/12* (2013.01); *G04B 47/042* (2013.01); *A44C 17/001* (2013.01); *Y10T 29/24* (2015.01)

(58) Field of Classification Search
USPC ..... 63/28
See application file for complete search history.

(56) References Cited

U.S. PATENT DOCUMENTS

| | | | | |
|---|---|---|---|---|
| 4,761,865 | A * | 8/1988 | Magnien | A44C 17/04 29/10 |
| 4,800,738 | A * | 1/1989 | Bunz | A44C 17/04 63/26 |
| 5,077,988 | A | 1/1992 | Poll | |
| 5,657,646 | A | 8/1997 | Rosenberg | |
| 5,943,302 | A * | 8/1999 | Fanshaw | G04B 37/0008 368/276 |
| 2006/0123846 | A1 | 6/2006 | Espinosa et al. | |
| 2007/0109918 | A1* | 5/2007 | Furetta | G02F 1/1335 368/294 |
| 2007/0151293 | A1* | 7/2007 | Essich | A44C 17/02 63/3.1 |
| 2007/0204463 | A1* | 9/2007 | Apprederisse | A44C 17/04 29/896.3 |
| 2008/0147882 | A1 | 6/2008 | Reif et al. | |
| 2008/0148772 | A1 | 6/2008 | Bauman et al. | |
| 2009/0229307 | A1 | 9/2009 | Kwan | |
| 2011/0110201 | A1* | 5/2011 | Boularas | A44C 15/0015 368/285 |
| 2012/0225314 | A1* | 9/2012 | Grossenbacher | A44C 17/005 428/600 |
| 2012/0243387 | A1* | 9/2012 | Jamin | G04B 5/16 368/151 |

FOREIGN PATENT DOCUMENTS

| | | | |
|---|---|---|---|
| EP | 0346753 | | 12/1989 |
| EP | 2106716 | A1 | 10/2009 |
| EP | 2327323 | | 6/2011 |
| EP | 2327323 | A1 | 6/2011 |
| FR | 2855947 | | 12/2004 |
| FR | 2855947 | A1 | 12/2004 |
| FR | 2889423 | | 2/2007 |
| FR | 2889423 | A1 | 2/2007 |
| JP | S-57101782 | | 6/1982 |
| JP | S57101782 | A | 6/1982 |
| JP | S-60169570 | | 9/1985 |
| WO | WO/98/21630 | | 5/1998 |
| WO | WO/2006/056860 | | 6/2006 |
| WO | WO/2008/102957 | | 8/2008 |
| WO | WO-2008/102957 | A1 | 8/2008 |

OTHER PUBLICATIONS

R. J. Jacques, "Bjoux Et Pierres Precieuses", Apr. 10, 2010, 7 pages.

R. J. Jacques, "Jewels and Precious Stones—The Real Story of Jewellery, Cleared of Publicists Storytellings", The Refractive index, Apr. 19, 2010, 7 pages.

R. J. Jacques, "Bijoux Et Pierres Precieuses", Apr. 10, 2010, 7 pages.

International Preliminary Report on Patentability for PCT/EP2014/052497, dated Feb. 7, 2014, 6 pages.

Chinese Office Action for CN 201480008204.8, dated Jun. 14, 2016, 4 pages.

Chinese Search Report for CN 201480008204.8, dated Jun. 3, 2016, 3 pages.

Chinese Office Action for CN 201480008204.8, 7 pages.

European Search Report for EP Application No. 14 703827.7, dated Jun. 9, 2017. 5 pages.

* cited by examiner

TIMEPIECE PART, AND METHOD FOR PRODUCING SUCH A TIMEPIECE PART

TECHNICAL FIELD

The present invention relates to a timepiece part, for example and nonlimitingly a dial or an oscillating weight. The present invention also relates to a method for manufacturing such a part.

PRIOR ART

Watches, especially luxury watches, made of metal, are often set with precious, semiprecious or synthetic stones.

Examples of precious stones for example and nonlimitingly include diamond, sapphire, emerald and ruby. Examples of semiprecious stones for example and nonlimitingly include spinal, amethyst, tourmaline, citrine and quartz.

Precious or semiprecious stones are often transparent.

Their table, i.e. the top portion of the stone, may have various shapes, it may for example be round, oval, square, heart-shaped, etc. These stones are cut in general so as to optimize their brilliance.

The ratio between the total width of the stone and its height is very important: for example a stone that is too flat or too thick will lead to a substantial loss of brilliance. The ratio chosen also depends on the type of stone and especially on the refractive index of the material. However, conventional stones made of the aforementioned materials have a height to width ratio of 65% to 80%. The height is therefore 65% to 80% of the width of the stone.

In this context, a stone is defined as flat if the ratio between its height and its width is lower than 50%.

Over the last few decades the use in the watch and clock making industry of flat stones, for example stones cut with what is referred to as a Russian cut, has gradually ceased. This is because flat stones exhibit brilliance defects, which manifest themselves in various ways and that as a general rule involve a loss of brilliance in an exterior or interior portion of the stone. One such defect is referred to as "fish eye".

Therefore, to maximize the brilliance of set watches and jewelry, the dimensions of the stone as seen from in front (i.e. the dimensions of the table) are maximized. Thus, as a result of the proportion constraint (65% to 80%), the stone, and therefore its mount, is thicker. For this reason, in densely set commercially available timepieces, stones are in general wider in timepiece parts such as the bracelet or bezel, where the thickness constraints are less stringent than on the dial.

Other watches, which are also commercially available, comprise flat precious stones, for example having a height-to-width ratio of 40% to 45%. However, these stones have a brilliance that is clearly worse than that of non-flat stones.

Transparent stones that are said to be "colorful" or colored—which may be precious, semiprecious, natural or synthetic—have the particularity of not reflecting the entire spectrum of light, but only some of the spectrum in the visible field. Each colorful stone thus possesses a characteristic response spectrum to luminous stimulation.

In contrast to stones that are not colorful (or "colorless" stones), for which it is important to maximize the intensity and distribution of the reflected light, and therefore brilliance, for colored stones it is also important to maximize the coloring of the stone. As a general rule, the more intense the color of the stone, the greater its desirability.

In order to obtain a stone the color of which is as intense as possible, it is also important to maximize its height relative to its width. Colored stones therefore almost always have a conventional cut.

Precious or semiprecious stones are historically set into supports made of precious metals such as gold, platinum or silver. It is at the present time also common to use steel or brass, and sometimes titanium or aluminum.

Frequently, the titanium or aluminum is plated after the stone has been set, so as to obtain protection from corrosion and to maximize brilliance.

Mounts made of titanium or aluminum are in particular used to set parts having conventional dimensions (i.e. stones that are not flat); the contrast in the brilliance of the stones and the appearance of the titanium or aluminum sets off the stones. Such mounts made of titanium or aluminum therefore have a large thickness in order to accentuate the brilliance of the stones.

US2009229307 describes a timepiece part, for example a watch case, comprising a titanium or aluminum mount with apertures for receiving stones.

FR2855947 relates to a method for setting a stone into an element made of metal, for example of titanium. A tool is applied to the surface of the metal part in order to form a lip on the girdle of a stone. This lip allows the stone to be immobilized in its hole. With the tool, it is also possible to form imprints on the surface of the metal part, which may contain facets. The imprints located adjacent the stones allow the latter to be retained, the other imprints have the function of reflecting light.

EP2327323 relates to a decorative part, for example a timepiece part, comprising stones and a device for fastening the stones relative to one another, this fastening device comprising a single support allowing the stones to be attached relative to one another. The single support comprises at least two layers, the first of which may comprise titanium and/or aluminum.

FR2889423 relates to a removable piece of jewelry that may be used to create or modify a customized final piece of jewelry, without the need for a jeweler. This piece of jewelry comprises a movable device, consisting of a sleeve into which one or more stones or pearls are set, and having an aperture into which a cap, that is equipped with a spring, may be inserted. The sleeve and the cap may be made of titanium or anodized aluminum.

WO2008102957 relates to a decoration stone comprising various layers, especially: an aluminum mounting (plating) layer formed on a back surface of the stone body, a hot melt part formed on a lower surface of the aluminum mounting layer, a coating layer which is formed on an upper surface of the stone body and consists of a printing ink absorption fixing agent, a UV coating layer, and a painting layer.

JPS57101782 relates to a method for manufacturing a dial from a titanium sheet.

However there remains a need for thinner timepiece parts, for example and nonlimitingly dials, oscillating weights, hands, etc. set with colored stones, but in which the smaller thickness of the stones does not adversely affect their coloring.

In other words, there is a need for a method for setting parts of small thickness with colored stones.

In this context the expression "small thickness" indicates a thickness smaller than 1 mm, preferably smaller than 0.8 mm, for example 0.6 mm.

BRIEF SUMMARY OF THE INVENTION

One aim of the present invention is therefore to provide a timepiece part exempt from at least certain of the limitations of known parts.

Another aim of the invention is to provide a timepiece part set with colored stones and having a small thickness, in which the stones are as colored as possible.

According to the invention, these aims are achieved especially by means of a timepiece part according to claim 1 and a method for manufacturing a timepiece part according to claim 11.

The timepiece part according to the invention comprises:

at least one colored transparent stone; and a mount comprising at least one aperture for receiving this stone.

The ratio between the height and width of this stone may be lower than about 50%, i.e. the colored transparent stone is a flat stone. Advantageously, the mount is made of anodized titanium or anodized aluminum: specifically, these metals have a good optical behavior because they do not reflect all the light.

Mounts made of anodized titanium or anodized aluminum are known. Their use in combination with flat stones is however unexpected, because flat stones are generally considered to be less beautiful, and therefore have been discarded in the watch and clock making industry for tens of years.

In particular, the use of colored transparent flat stones is surprising, because there is a long-held prejudice in the watch and clock making industry and in the jewelry industry that says that it is not possible to obtain good coloring effects with flat stones.

A fortiori, the use of flat colored stones in combination with a titanium or aluminum mount is completely unexpected, because even if a person skilled in the art were to have envisioned such a combination, they would a priori have expected to obtain a part in which the flat stones were not very brilliant, suffered from fish eye defects, and contrasted poorly with the mount.

Against all expectation, tests have however shown that combining colored transparent flat stones with a mount made of anodized titanium or anodized aluminum allows stones with a significant coloring to be obtained despite their small thickness because the color given to the mount by the anodization process influences the color of the flat stones, which color may thus be reinforced and therefore improved.

The invention is therefore based on the observation that the brilliance and coloring of a stone must be evaluated depending on the mount on which it is mounted. A stone considered to be very beautiful in isolation may lose its qualities on an unsuitable mount; conversely, and in the way used in the invention, a stone considered to be of little value in isolation may prove to be outstanding on a particular mount.

The choice of a mount made of anodized aluminum or anodized titanium therefore allows the color and/or reflectance of the mount to be adapted to the type of stone that it is desired to set, in order to obtain a very brilliant and/or very intensely colored assembly even when the stones employed do not, themselves, have these qualities.

Specifically, if at least some of the stones have the same color as that given to the mount by the anodization process, a portion of the light passes through the stone and reaches the metal located underneath and is then reflected. The coloring of these light rays is therefore obtained by subtraction of certain wavelengths through the colorful stone, but also during the reflection from the metal. The coloring of the stone is therefore reinforced by the mount.

Therefore one of the advantages of the invention is the obtainment of colored transparent stones of significant coloring despite the small thickness of the mount (smaller than 1 mm, preferably smaller than 0.8 mm, for example 0.6 mm).

In a preferred variant, the surfaces defining the aperture for receiving the colored transparent stone are also anodized. In another preferred variant, the setting elements, for example claws or grains, are anodized or the same color as the mount.

Specifically, if the stone is a first color, the mount is a second color chosen so as to reinforce this first color. In a preferred variant this first color is equal to the second color.

In other words, there is a synergy between the first and second colors allowing the coloring of the mount to be added to that of the colored transparent stones. If a plurality of stones are present in the mount, this synergistic effect also allows the uniformity of the coloring of the part to be improved.

Specifically, in the case where colored transparent stones, which are preferably round and of various diameters, are "snow set", i.e. placed as closely as possible to each other and with different cuts, it is very difficult to make the color of the stones uniform, certain stones being lighter or darker or having different colorings. The anodization of the mount allows a coloring to be added to the colored transparent stones and thus the uniformity of the color of the part to be improved.

In another variant, it is also possible to produce a shift between or even an intentional relative opposition of the colors of the mount and that of the colored transparent stone.

In another variant it is also possible to have a plurality of transparent stones of various colors and/or for the mount of the stones to have various colorings.

Another advantage of the invention is that it makes it possible to use large stones in a surround of small thickness, that would not be usable with a stone that was not flat. This advantage is moreover independent of the shape of the stone, which may be round or any other even complex shape (baguette cuts, marquise cuts, etc.).

In one preferred variant the aperture is a through-aperture, i.e. it passes right through the mount.

Placing through-apertures under each stone also allows a degree of transparency to be given to the part. This is all the more the case since the colored through-stones being flat, some of the light originating from the end opposite the table passes through the aperture and therefore illuminates the stones from behind.

Placing through-apertures under each stone also allows a "stained-glass window" effect to be achieved with the part, thereby allowing a coloring to be kept both when the light originates from in front and behind the set part.

Lastly, through-apertures under each stone allow a good uniformity for the anodization-produced coloring of the mount and cleaning out the treatment products after the mount has been colored.

In a preferred variant the timepiece part according to the invention consists of a dial. In another variant it consists of an oscillating weight.

The invention also relates to a method for manufacturing a timepiece part comprising the following steps:

producing in a mount at least one aperture;

setting a colored transparent stone into this aperture, this colored transparent stone having a ratio between its height and width lower than 50%; and anodizing said mount.

BRIEF DESCRIPTION OF THE FIGURES

Examples of implementation of the invention are indicated in the description illustrated by the appended figures, in which.

EXEMPLARY EMBODIMENT(S) OF THE INVENTION

In the following description, which is given by way of example, reference will be made, for the sake of simplicity, to a dial. However, the invention is not limited to such a part. The invention is also not limited to the watch and clock making industry but also includes, for example, jewelry components.

Figure 1:
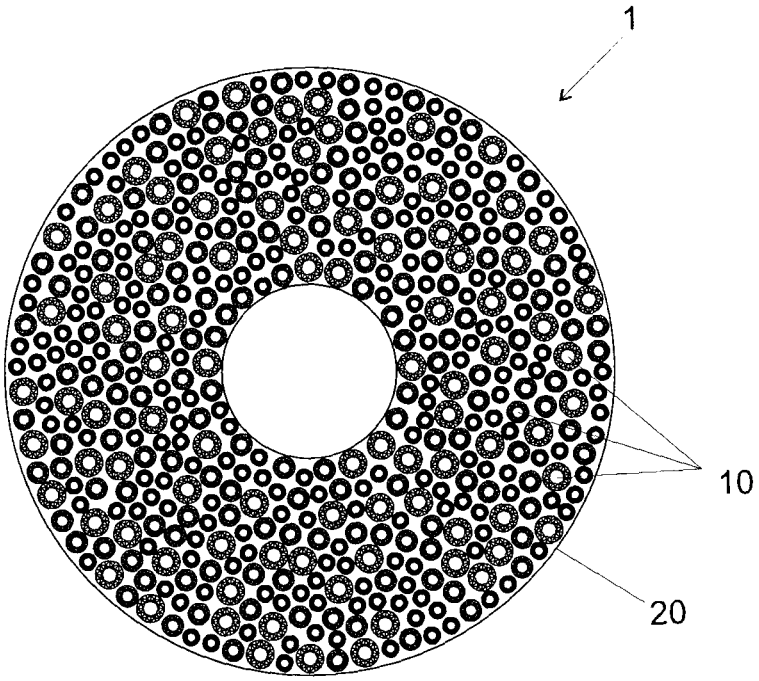
FIG. 1 illustrates an example of a top view of one embodiment of the part according to the invention.

FIG. 1 illustrates an example of a top view of a dial 1 according to the invention.

Figure 2:
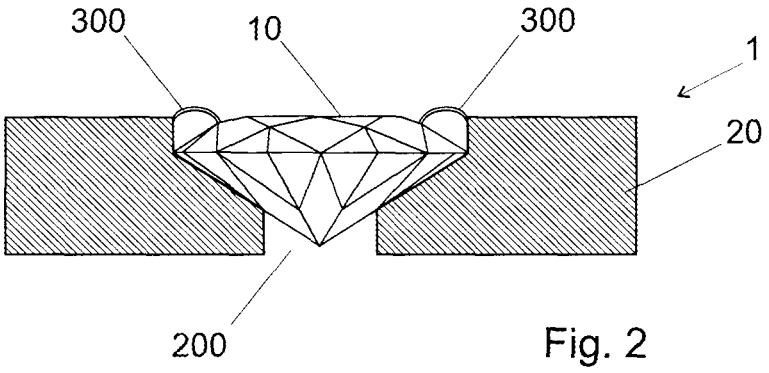
FIG. 2 illustrates an example of a cross section through one embodiment of the part according to the invention.

The timepiece part 1 according to the invention comprises:

at least one colored transparent stone 10; and a mount 20 comprising at least one aperture 200, shown in FIG. 2, for receiving this stone 10.

Figure 4:
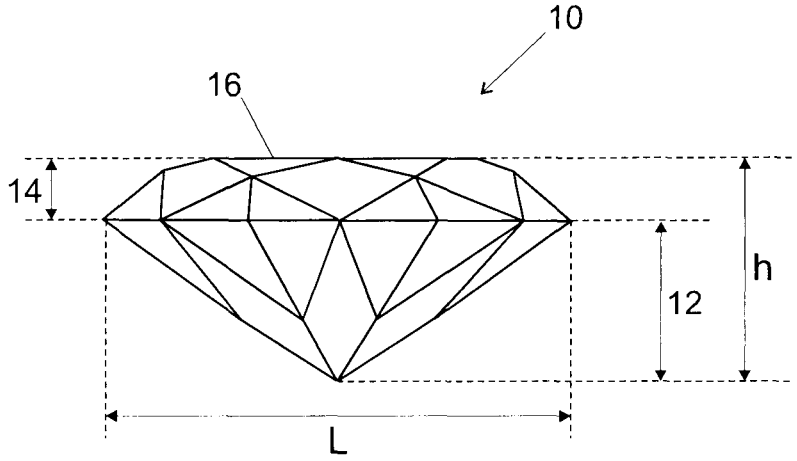
FIG. 4 illustrates one example of a cross section through one embodiment of the colored transparent stone of the part according to the invention.

Advantageously, the ratio between the height h and the width L of the stone 10, as illustrated in FIG. 4, is lower than 50%, i.e. the colored transparent stone is a flat stone.

Advantageously, the mount 20 is made of anodized titanium or anodized aluminum. The anodization is as a general rule carried out after the part 1 has been set and polished.

Combining flat colored transparent stones 10 with a mount made of anodized titanium or anodized aluminum 20 allows stones 10 with a significant coloring to be obtained despite the mount 20 having a small thickness e (as may be seen in FIG. 3) because the color given to the mount 20 by the anodization process influences the color of the flat stones 10, which color is thus reinforced and therefore improved.

Specifically, if at least some of the stones 10 have the same color as that given to the mount 20 by the anodization process, some of the light passes through the stone and reaches the metal located underneath and is then reflected. The coloring of these light rays is therefore obtained by subtraction of certain wavelengths through the colorful stone 10, but also during the reflection from the metal of the mount 20. The coloring of the stone 10 is therefore reinforced by the mount 20.

Therefore one of the advantages of the invention is the obtainment of colored transparent stones 10 of significant coloring despite the small thickness e of the mount 20 (smaller than 1 mm, preferably smaller than 0.8 mm, for example 0.6 mm), or in any case despite the small depth of the apertures into which the stones are set.

The colored transparent stone 10, shown in FIG. 4, has a table 16, i.e. an upper portion of the stone, that may be various shapes, for example round, oval, square, heart-shaped, etc. The ratio between the height of the pavilion 12 and that of the crown 14 depends on the type of cut of the stone 10.

Figure 3:
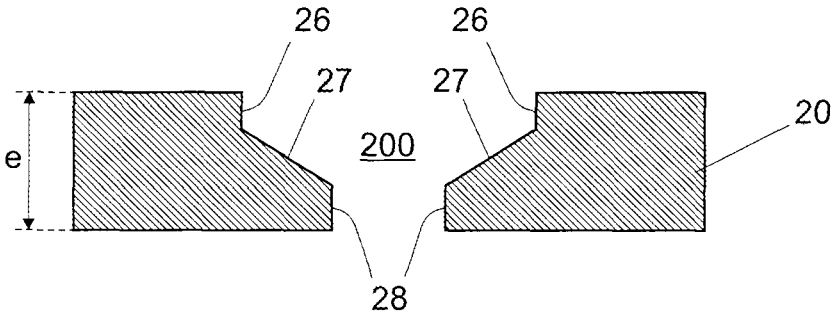
FIG. 3 illustrates an example of a cross section through one embodiment of the mount of the part according to the invention.

In a preferred variant, illustrated in FIG. 3, the lateral surfaces 26, 27 and 28 and the optional bottom of the aperture 200 that receives the colored transparent stone are also anodized and colored. In a preferred variant, the setting elements 300, shown in FIG. 2, for example claws or grains, are anodized and the same color as the mount 20.

Specifically, if the stone 10 is a first color, the mount 20 is a second color chosen so as to reinforce this first color. In a preferred variant, this first color is equal to the second color. If a plurality of stones are present in the mount, this synergistic effect also allows the uniformity of the coloring of the part 1 to be improved.

In the example in FIG. 1, in which the colored transparent stones 10 are round, of various diameters and "snow set", i.e. placed as closely as possible to each other, it is very difficult to make the color of the stones uniform, certain stones being lighter or darker or having different colorings. The different size of the stones in a snow setting thus gives the impression of different colors.

The anodization of the mount 20 allows a coloring to be added to the colored transparent stones 10 and thus the uniformity of the coloring of the part 1 to be improved.

In the variant in FIG. 2, the aperture 200 is a through-aperture, i.e. it passes right through the mount 20. In this case, the stones have a height h substantially equal to the thickness e of the mount 20, as may be seen in FIG. 2.

Through-apertures 200 under each stone allow the coloring process to reach the surfaces 26, 27, 28 of the mount 20 under the stones 10. Thy also allow a degree of transparency to be given to the part 1. Through-apertures 200 under each stone 10 also allow a "stained-glass window" effect to be achieved with the part 1, thereby allowing a coloring to be kept both when the light originates from in front and behind the set part.

Lastly, through-apertures 200 allow a good uniformity to be obtained for the anodization-produced coloring of the mount and for cleaning out treatment products after the mount has been colored.

Stones set into blind apertures may however also be used.

REFERENCE NUMBERS EMPLOYED IN THE FIGURES

1 Timepiece part
10 Colored transparent stone
12 Pavilion
14 Crown
16 Table
20 Mount
26 First surface defining the aperture
27 Second surface defining the aperture
28 Third surface defining the aperture
200 Aperture
300 Setting element
e Thickness of the mount
h Height of the colored transparent stone
L Width of the colored transparent stone

The invention claimed is:

1. A timepiece part comprising:

at least one colored transparent stone wherein said colored transparent stone comprises a crown portion and a pavilion portion which has an end extremity; and a mount comprising at least one aperture for receiving said colored transparent stone;

wherein the ratio between the height and width of said colored transparent stone is lower than 50%;

said mount is made of anodized titanium or anodized aluminum;

the at least one aperture has lateral surfaces;

said lateral surfaces comprise:

first lateral surfaces arranged for receiving the crown portion of the colored transparent stone;

second lateral surfaces arranged for receiving the pavilion portion of the colored transparent stone;

third lateral surfaces arranged for receiving the end extremity of the colored transparent stone;

the at least one aperture is a through aperture, and comprises a first end at said crown portion of the colored transparent stone, and a second end at the end extremity of the colored transparent stone;

first, second and third lateral surfaces are anodized, the anodization process being performed after the setting of the colored transparent stone, by exploiting the second end of the through aperture, so that the anodization process reaches first, second and third lateral surfaces.

2. The timepiece part of claim 1, wherein said colored transparent stone is a semiprecious or precious, natural or synthetic cut stone.

3. The timepiece part as claimed in claim 1, comprising setting elements that are anodized.

4. The timepiece part as claimed in claim 1, said mount having a thickness smaller than 1 mm.

5. The timepiece part as claimed in claim 1, said colored transparent stone being a first color, said mount being a second color chosen so as to reinforce said first color.

6. The timepiece part as claimed in claim 5, the first color being equal to the second color.

7. The timepiece part as claimed in claim 1, consisting of a dial.

8. The timepiece part as claimed in claim 1, consisting of an oscillating weight.

9. A method for manufacturing a timepiece part as claimed in claim 1, comprising the following steps:

producing in a mount at least one aperture;

setting a colored transparent stone into said aperture, said colored transparent stone having a ratio between its height and width-lower than 50%; and anodizing said mount.

10. The method of claim 9, wherein the anodization process is performed after the setting of the colored transparent stone, by exploiting the second end of the through aperture, so that the anodization process reaches first, second and third lateral surfaces.

11. A The timepiece part of claim 1, wherein the end extremity of the pavilion portion of said colored transparent is pointed.

12. The timepiece part according to claim 11, wherein said pointed end extremity of the pavilion portion of said colored transparent has a single point only.

* * * * *